US005404921A

United States Patent [19]

Lamoreaux et al.

[11] Patent Number: 5,404,921

[45] Date of Patent: Apr. 11, 1995

[54] ROTARY FILL STATION FOR BREATHING APPARATUS

[75] Inventors: Charles L. Lamoreaux, Rancho Palos Verdes; Robert G. Jacobson, Long Beach, both of Calif.

[73] Assignee: American Bristol Industries, Inc., Harbor City, Calif.

[21] Appl. No.: 221,749

[22] Filed: Mar. 31, 1994

[51] Int. Cl.[6] ..... F17C 5/00

[52] U.S. Cl. ..... 141/97; 141/21; 141/145; 141/236; 141/237; 141/248

[58] Field of Search ..... 141/2, 3, 18, 20, 21, 141/97, 144, 145, 234, 236, 237, 242, 244, 197, 248; 137/257, 258; 312/209, 305; 222/3, 6

[56] References Cited

U.S. PATENT DOCUMENTS

| | | | |
|---|---|---|---|
| 3,166,107 | 1/1965 | Swenson et al. | 141/145 |
| 3,208,574 | 9/1965 | Anson | 141/197 X |
| 3,817,299 | 6/1974 | Koehler | 141/97 X |
| 4,506,708 | 3/1985 | Onuma | 141/144 X |
| 4,538,659 | 9/1985 | Adelman et al. | 141/97 X |
| 4,860,803 | 8/1989 | Wells | 141/18 X |
| 4,911,212 | 3/1990 | Burton | 141/18 X |
| 5,088,436 | 2/1992 | Stritmatter | 141/234 |
| 5,139,057 | 8/1992 | Benedetti | 141/18 |
| 5,209,273 | 5/1993 | Giuffredi et al. | 141/97 X |

FOREIGN PATENT DOCUMENTS

| | | | |
|---|---|---|---|
| 0537094 | 4/1993 | European Pat. Off. | 141/18 |
| 9093598 | 5/1984 | Japan | 141/197 |

OTHER PUBLICATIONS

American Bristol Industries, Inc., Harbor City, Calif: When The Heat Is On (2 pages).

Mako Compressors Inc., Ocala, Fla.: Mako Breathing Air Systems (Fill Stations-2 pages) Mako Breating Air Systems (Enclosed Fill Stations-2 pages) Performance Proven (The Mako Breathing Air Center-7 pages).

Ingersoll-Rand, Pleasant Garden, N.C.: Talon (Cylinder Refill System-6 pages) Baron II (Cylinder Refill System-8 pages).

*Primary Examiner*—J. Casimer Jacyna

*Attorney, Agent, or Firm*—Henry M. Bissell

[57] ABSTRACT

A system for charging compressed air cylinders with air for breathing incorporates a fragmentation containment chamber having walls of ¼" minimum thickness steel plate and a carousel mounted in the front panel for transferring the cylinders into and out of the chamber. Specially configured locking plates are moved in and out of locking position for the carousel in accordance with the pressurizing operation. A rotary valve serves to insure that compressed air can only be transferred to the cylinders within the cylinder when they are in position for charging and not to the cylinders outside the chamber. A grating at the bottom of the chamber permits high pressure air to exit the chamber safely in case of any malfunction. Safety interlocks and automatic controls operate in accordance with rotation of the cylinders on the carousel results in the easy, rapid and safe charging of the breathing air cylinders.

22 Claims, 4 Drawing Sheets

ROTARY FILL STATION FOR BREATHING APPARATUS

BACKGROUND OF THE INVENTION

1. Field of the Invention

This invention relates to systems for charging breathing apparatus cylinders and, more particularly, to such a system for automatically transporting a cylinder into a containment chamber, charging the cylinder, and transporting it out of the chamber for use.

2. Description of the Related Art

Compressed air for breathing is stored in portable cylinders ("air bottles") and used by Scuba divers and fire fighters, the principal users of such air bottles. For Scuba divers the cylinders are usually charged to either 2250 or 3000 pounds per square inch (psi), depending on the cylinder structure, in a water tank to provide cooling. Bottles for fire fighter use are typically charged to 2350, 3000 or 4500 psi in a dry environment. The cylinders for storing breathing air must be inspected at regular intervals and are also subjected to periodic hydrostatic testing. Despite these precautions, cylinders do occasionally rupture and it is therefore important to provide for the containment of explosive discharge of fragments and compressed air on such an occasion and to protect personnel and equipment in the near vicinity.

The charging systems which are delivered for use by fire departments are generally more sophisticated and more foolproof, principally because of the higher pressures and more frequent cycling of the cylinders, than those in dive shops. A number of companies manufacture cylinder refill systems of the type described. For example, Mako Compressors, Inc. of Ocala, Fla. markets a line of fill stations of varying degrees of complexity and sophistication under the MAKO trademark. Ingersoll-Rand Company, Breathing Air Division, of Pleasant Garden, N.C. markets cylinder refill systems under its TALON and BARON II trademarks. American Bristol Industries, Inc. of Harbor City, Calif. produces air charging systems in both stationary and mobile units, the latter being available in trailer- and truck-mounted versions, for use by fire departments.

Each of these units presently on the market presents one particular drawback: the cylinders must be lifted over a lip or threshold which is located at about hip height on the average person. The need to lift a relatively heavy cylinder over the hip-high threshold to place the cylinder in position for filling places undue demand on the physical capabilities of the individuals involved, particularly when it may be necessary for a particular individual to handle a significant number of cylinders during the charging process. It would be a definite improvement in systems of the type described if a way were found to accommodate the introduction of the cylinders into the fill chamber without the need to lift them to hip height or higher during their handling. It would also be an improvement over present systems if the charging process could be made safer and more automated, as well as accelerated in operation.

SUMMARY OF THE INVENTION

In brief, arrangements in accordance with the present invention offer these improvements. One particular embodiment utilizes a turntable or carousel structure in conjunction with a protective pressure containment chamber and a charging system for each pair of cylinders which is activated as a cylinder pair is transported into the chamber and de-activated as the cylinders are transported out of the chamber. The base of the turntable is at a level near the floor and accommodates four separate breathing apparatus cylinders (BACs). The system charges each BAC at a rate not to exceed a pressure rise of 1500 psi per minute without water immersion or spray. (This is recommended by virtually all fiber-wrapped BAC manufacturers.) Alternative versions of the system might be adapted to accommodate six, eight or some other selected number of BACs.

In this embodiment, the system design is such that two BACs are charged within the chamber while two BACs are coupled to the charging system and are made ready on the outside of the chamber. When the first two BACs are charged, they are rotated out of the chamber as the "ready" BACs are rotated into the chamber. This procedure results in four 30-minute BACs being charged every five minutes.

The charging system of the invention incorporates charging adapters of the "ridged-fast-attach" type which are mounted near the central axis of the turntable at a level approximately three feet above floor level to provide coupling to the air passage at the top of the cylinders. Embodiments of the invention contain safety interlocks such that if the chamber is not closed and locked, air cannot flow into the BACs which are inside the chamber for charging. The passages in and out of the chamber automatically lock and unlock in accordance with air flow being turned on and off. Compressed air can flow only to the pair of BACs inside the chamber, not to those on the carousel outside the chamber.

The opening for the carousel in the front wall of the fill chamber is secured for explosion containment by a steel plate which is oriented along a diameter of the turntable. This plate extends from bottom to top and from side to side of the opening with a small peripheral gap to permit the plate and carousel to be rotated within the opening. To close this peripheral gap when the turntable is set for filling a pair of BACs within the containment chamber, two slidable angled locking plates are mounted inside the chamber against the front wall next to the sides and top of the opening. These are elevated out of the way by a cam that is operated manually by a lever or automatically by a pneumatic actuator when the turntable is cleared for rotation and are permitted to slide downward and toward the center of the opening into locking position between the carousel plate and the front wall of the containment chamber when the carousel is stationed in the fill mode. The plane of the angled locking plates is displaced slightly rearward from the plane of the front panel, and the turntable axis is slightly behind the plane of the locking plates. Thus, when the system is in the charging mode, the locking plates overlap along the outer face of the turntable plate and the inner surfaces of the front panel, thereby preventing any significant escape of an explosive discharge of air out the front of the chamber through the carousel opening. The discharge is contained by the walls of the chamber and directed out through a grating at the bottom.

The turntable is supported at the base by a self-aligning thrust bearing. The central support shaft has a hollow bore coupled to a rotary union through which air from an associated compressor and/or storage reservoir is admitted to the fill passages. This air passes through a central tube extending along the axis of the carousel to a rotary valve positioned at the top of the turntable plate. This is a conventional spherical valve, known in the trade as a "Ball valve", which has been modified for use in embodiments of the invention. An adapter supports the body of the valve within a bearing and the valve stem is fixed in position. Thus, as the valve body rotates with the turntable, a first port coupled to the charging manifold for the two cylinders within the containment chamber is rotated into position to receive compressed air from the core of the rotary valve. A second valve port which is coupled to the two "ready" cylinders and manifold outside the chamber is blocked from the compressed air source. As the carousel rotates to remove the filled BACs from the chamber and bring the ready cylinders into the chamber for filling, the first port is cut off and the second port is connected to the air passage in the valve core. Since the air passage in the core is always oriented toward the containment chamber, only the BACs in the chamber can be charged, thereby insuring safe containment of fragments in the event of BAC failure.

Embodiments of the invention contain instrumentation for monitoring both manual and automatic control of the charging process with valves and couplers for effecting control in manual as well as automatic operation.

BRIEF DESCRIPTION OF THE DRAWING

A better understanding of the present invention may be realized from a consideration of the following detailed description, taken in conjunction with the accompanying drawings in which.

DETAILED DESCRIPTION OF THE PREFERRED EMBODIMENTS

Figure 1:
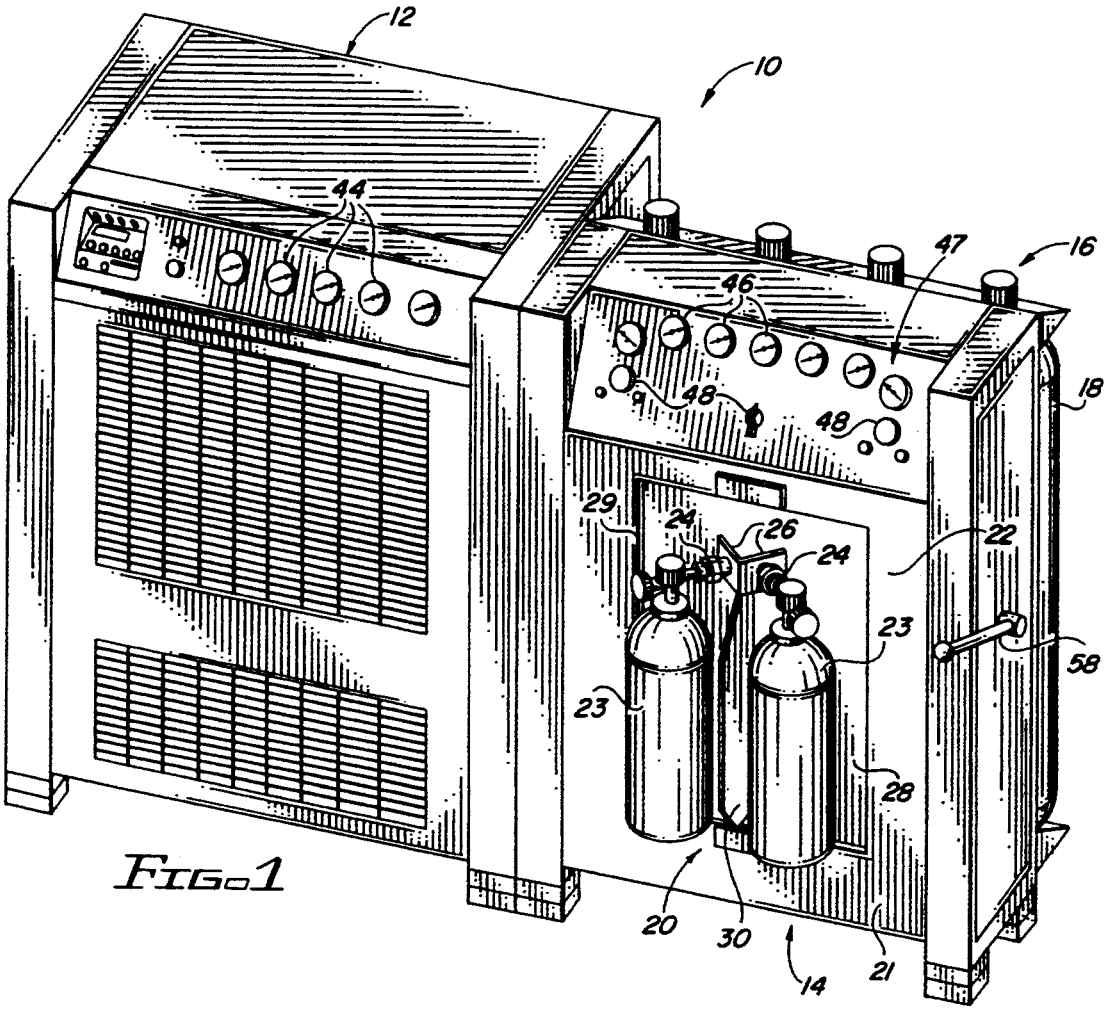
FIG. 1 is a schematic perspective view of a complete charging system in accordance with the present invention.

Referring now to FIG. 1, a complete charging system 10 in accordance with the invention is shown comprising a compressor module 12, a rotary fill station module 14 and an air storage assembly module 16. The module 16 is shown with four compressed air storage cylinders 18 which may serve as a reservoir for compressed air from a compressor in the module 12.

The rotary fill station module 14 is equipped with a carousel or turntable 20 mounted to the front panel 21 for rotation about a vertical axis within a generally rectangular opening 22. A pair of BACs 23 are shown on the carousel 20, coupled to a pair of ridged charge adapters 24. The adapters or couplers 24 are preferably of the "ridged-fast-attach" type which permit rapid coupling of an air fill passage to a BAC 23 and support the BACs on the carousel 20. The charge adapters 24 are mounted on a central support manifold 26. A similar charge adapter/manifold set is located on the back side of the carousel.

The carousel 20 has a central containment plate 28 which is only slightly smaller than the extent of the opening 22 so that when the plate 28 is aligned within the opening 22, as shown in FIG. 1, a small peripheral gap 29 exists between all edges of the plate 28 and corresponding edges of the opening 22 in the front panel plate 21.

Figure 1A:
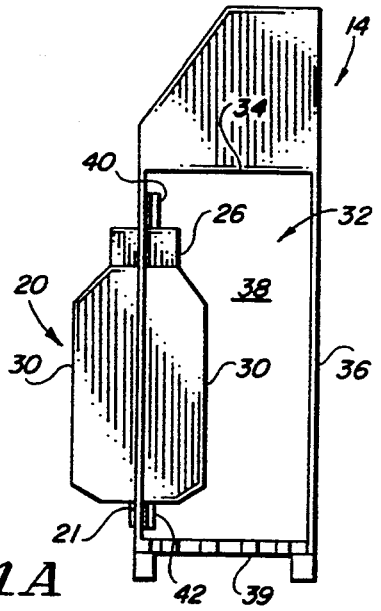
FIG. 1A is a schematic side sectional view of the charging chamber of FIG. 1.

Details of the actual containment vessel are shown in the schematic view of FIG. 1A in which the module 14 is shown encompassing a containment chamber 32 in which the charging of the BACs occurs. The containment chamber has protective plates on the top 34 and all sides including the back 36, left and right sides 38, and front panel 21. A grating 39 is mounted at the bottom of the containment chamber 32 to permit exhausting of any high pressure air from the containment chamber without injury or collateral damage to personnel or equipment. The containment chamber 32 is fabricated of ¼-inch (minimum) steel plates, as is the containment plate 28 of the carousel 20.

In addition to the containment plate 28, the carousel 20 has a pair of separator plates 30 extending orthogonally from opposite sides of the containment plate 28. As indicated schematically in FIG. 1A, the carousel 20 is supported for rotation in upper mount 40 and lower mount 42 which are attached to the inner face of the front panel 21. The compressor module 12 has a plurality of gauges 44 installed along its front panel, and similarly the fill station module 14 is provided with a plurality of gauges 46 and controls 48 for monitoring the operation of the system.

Figure 2:
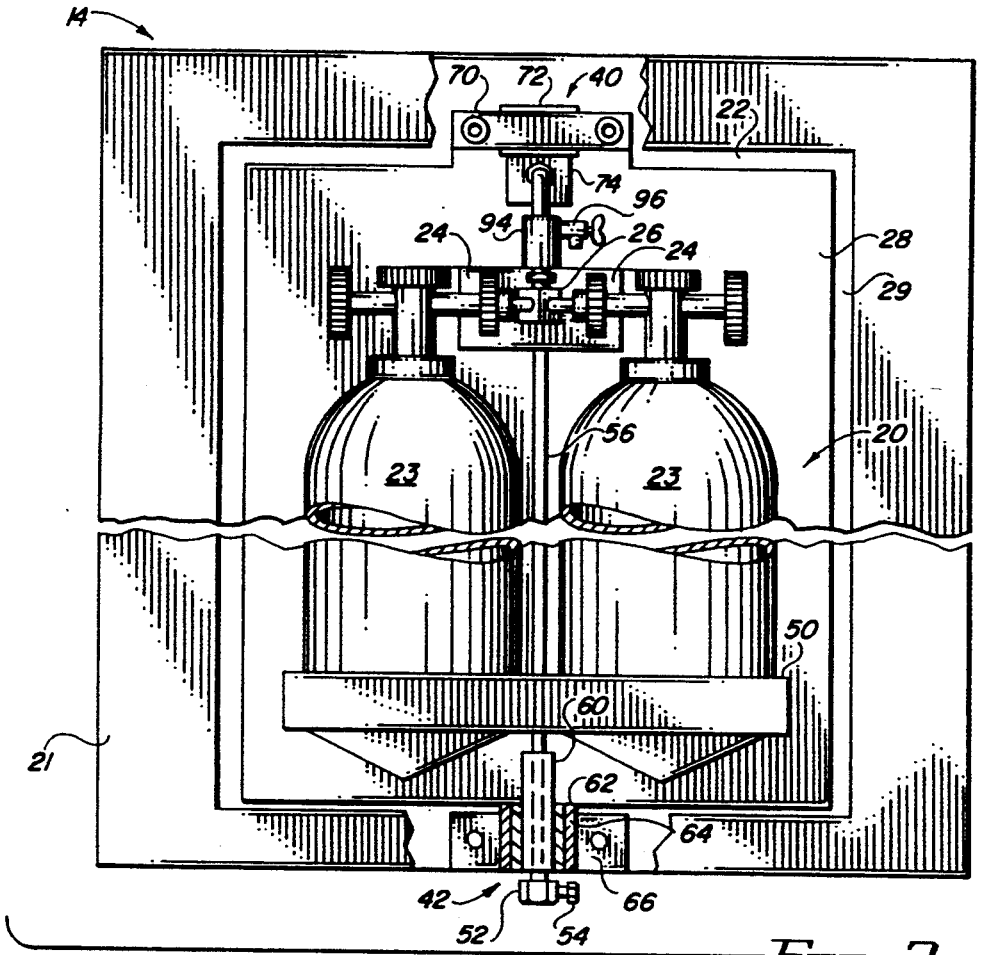
FIG. 2 is a schematic front elevation, partially broken away, showing the mounting of the carousel and protective separator plate of FIG. 1.

Further details of the carousel 20 and its mounting and porting arrangements are shown in the schematic drawing of FIG. 2. This is essentially like the version of FIG. 1 except that a band 50 is provided as an anti-swing guard for the BACs 23. This band 50 is mounted to the near side of containment plate 28 and another one is mounted on the other side (not in view).

The lower mount 42 for the carousel 20 is shown comprising a pivot element 60 mounted in a bearing 62 within a journal 64 affixed to a mounting plate 66. The mounting plate 66 is adapted for mounting to the inner face of the front panel 21. The pivot element 60 has a hollow bore for the passage of compressed air from the associated compressor and/or air storage system by way of a rotary union 52 and coupling 54 at the underside of the element 60. A tube 56 extends upwardly from the bore of the pivot element 60 along the vertical axis of the carousel 20 to a connection with the valve 74 at coupling 82 (see FIG. 3).

Figure 3:
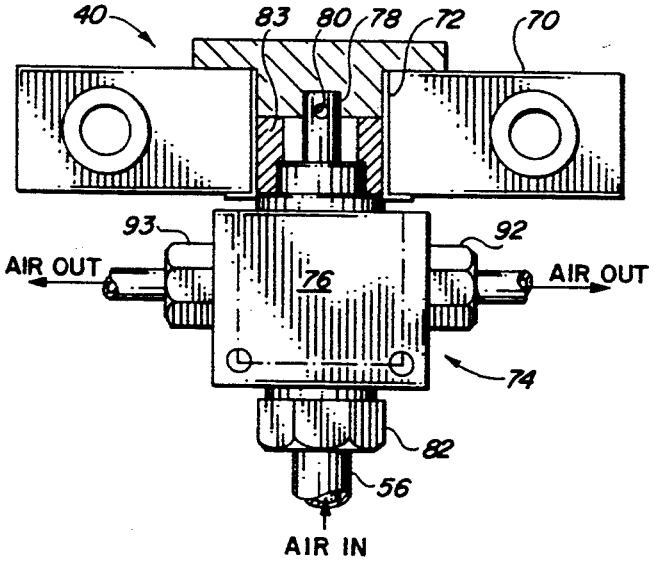
FIG. 3 is a schematic view in partial section showing the rotary valve at the top of the carousel of FIG. 2.

The upper mount 40 is shown comprising a mounting plate 70 for attachment to the inner surface of the front panel 21 at the upper end of the carousel 20. The mount 40 further comprises a bearing 72 and spherical valve 74 as more particularly shown in FIG. 3. The body 76 of the valve 74 is rotatable with the carousel 20 while the stem 78 is held fixed in position by a dowel pin 80. An adapter 83 supports the valve 74 for rotation within the bearing 72. It will be appreciated that the orientation of the body 76 relative to the mounting plate 70 in FIG. 3 is at an angle of 90 degrees relative to the way it is shown in FIG. 2.

Figure 4:
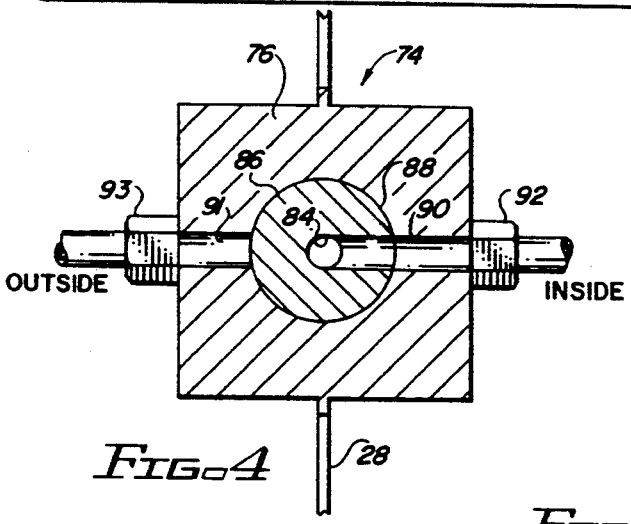
FIG. 4 is a schematic plan view, in section, of the valve of FIG. 3.

Compressed air enters the valve 74 through a coupling 82 at the underside thereof. This connects with a central passage 84 (see FIG. 4) in the spherical core 86 of the valve 74 which communicates with a transverse passage 88 positioned to communicate with one of two ports 90, 91 as the valve body 76 rotates around the stationary spherical core 86. Couplings 92 and 93 connect to the respective ports 90, 91 of the valve body 76 for carrying compressed air from the valve 74 to the BACs 23 which are within the containment chamber in position for filling.

Each coupling 92, 93 connects to a corresponding tee member such as 94 (see FIG. 2) which in turn connects to the manifold 26 on the same side of the protective separator plate 28. A bleed valve 96 is mounted to the tee member 94 for bleeding the associated manifold 26 after the BACs 23 are charged and transferred to the outside of the chamber 32.

Figure 5:
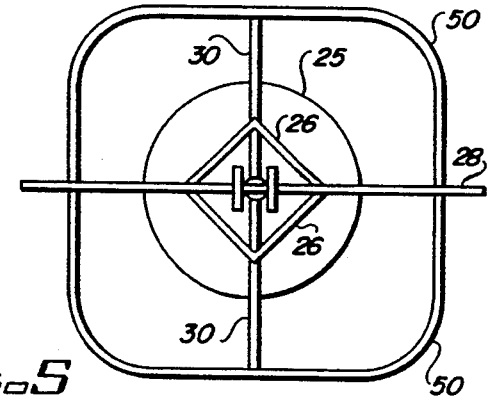
FIG. 5 is a schematic plan view of the carousel of FIG. 2.

FIG. 5 is a schematic plan view of the carousel 20 showing a turntable base 25, containment plate 28, separator plates 30, guard bands 50 and manifolds 26.

Figure 7:
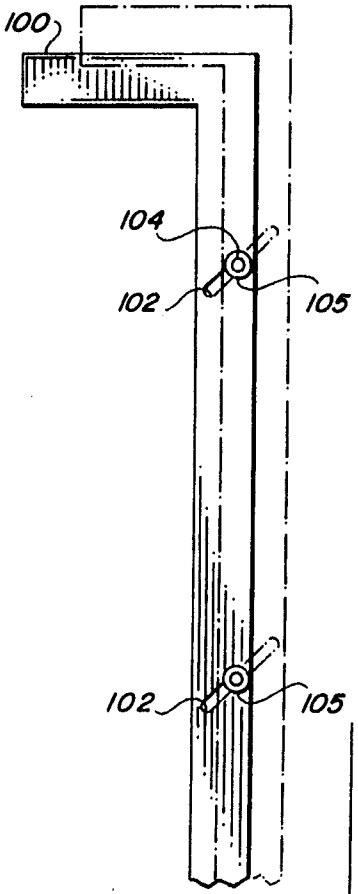
FIG. 7 is a schematic view taken from inside the chamber showing particular details of an angled locking plate of FIG. 6.
Figure 6:
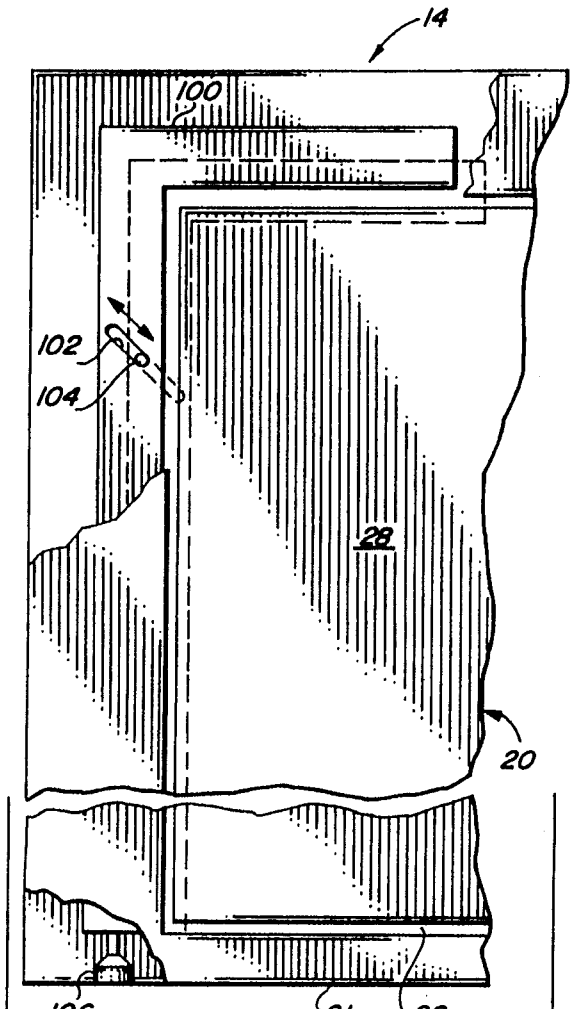
FIG. 6 is a schematic plan view, partially broken away, of a portion of the system of FIG. 1 showing an arrangement for locking the protective separator plate of FIG. 2.

The protective locking arrangement for the carousel 20 is represented schematically in FIGS. 6 and 7. FIG. 6 shows the carousel 20 with the containment plate 28 in position for locking across the opening 22 of the front panel 21. The system has two angled locking plates 100, one on each side and partly along the top of the opening 22. The locking plate 100 of FIG. 6 is shown in the retracted position in solid outline and in broken outline in the locking position. The plate 100 has a pair of slots 102 angled at 45 degrees which support the locking plate 100 on corresponding shoulder bolts 104 which are threaded into the front panel 21. A pneumatic actuator 106 in FIG. 6 is mounted at the bottom of the panel 21 and serves to raise the locking panel 100 when the actuator 106 is pressurized. Raising the plate 100 moves it 45 degrees upward and to the left in FIG. 6 so that it clears the edges of the plate 28 and permits the turntable 20 to be rotated. With the turntable 20 in position so that the plate 28 blocks the opening 22, air to the actuator 106 is cut off and the plate 100 is permitted to move downward and inward to the position shown in broken outline. The plate on the opposite side of opening 22 is similarly controlled. In the locking position, the plates 100 extend between and overlap both the plate 28 and the front panel 21, thereby preventing the containment plate 28 from any displacement when locked.

FIG. 7 is a view from the rear of the panel 21 and locking plate 100, inside the containment chamber. In FIG. 7 the retracted position of the locking plate 100 is shown in broken outline while the extended or locking position is shown in solid outline. It will be noted that the shoulder bolts 104 are provided with heads 105 which retain the plate 104 in position against the inner face of the panel 21.

Figure 8:
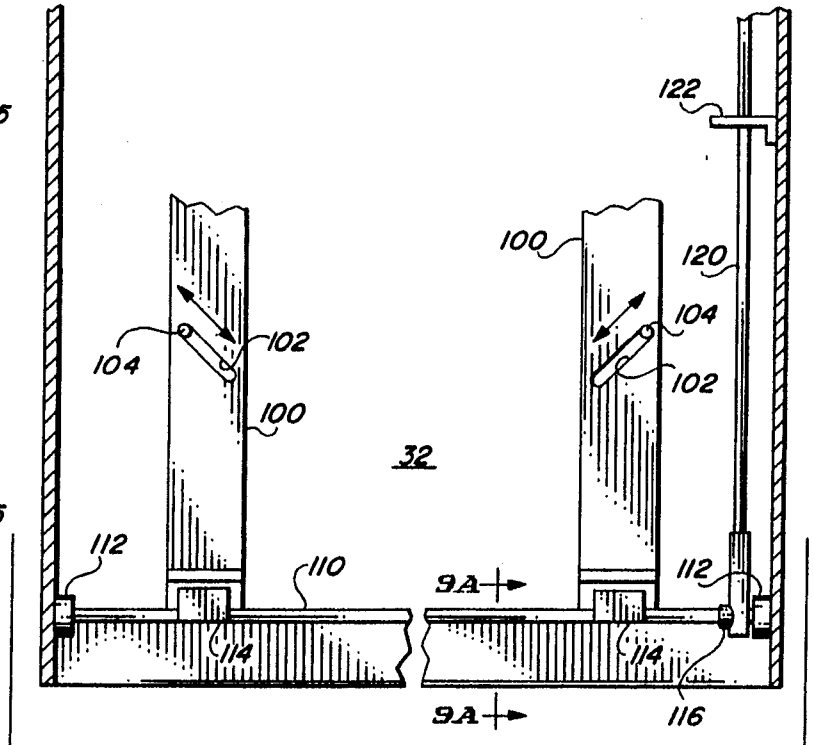
FIG. 8 is a schematic diagram representing an alternative arrangement to that shown in FIGS. 6 and 7 for locking the protective separator plate of FIG. 2.
Figure 9A:
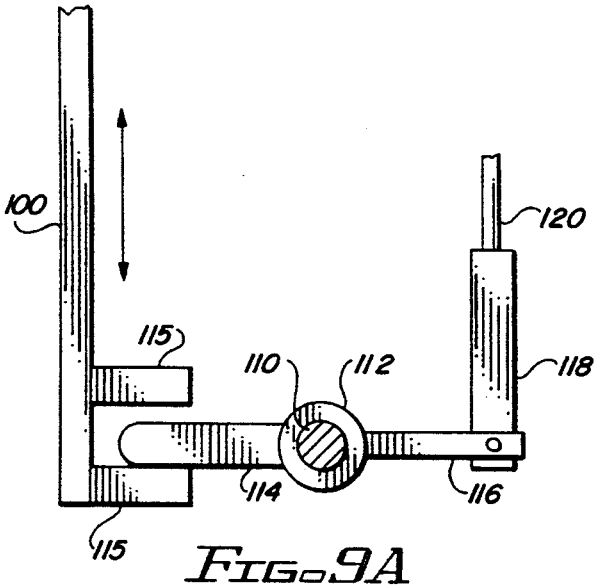
FIG. 9A is a schematic side view taken along the line 9A—9A of FIG. 8, looking in the direction of the arrows.

The system is also arranged for manual control of the charging operation. A lever 58 on the side of the module 14 operates through a linkage arrangement to manually unlock the locking plates 100, thereby releasing the carousel 20 for rotation. Rotation of the carousel 20 is effected manually, for safety reasons. This alternative locking plate control arrangement which permits manual operation is shown in FIG. 8. In this figure and in FIG. 9A, which is a side sectional view of a portion of the apparatus of FIG. 8, a cross shaft 110 is shown mounted in bearings 112 located at opposite sides of the containment chamber 32. The cross shaft 110 supports a pair of cams 114 in positions suited to bear against follower elements 115 to raise and lower the locking plates 100. As seen in FIG. 9A, a lever 116 extends from the shaft 110 opposite the lever 114 for attachment to a link 118 which is threadably coupled to a rod 120 that extends upward through a support bracket 122 for coupling with the handle 58 on the outside of the fill station module 14 (see FIG. 1). Lowering the handle 58 serves to raise the locking plates 100, moving them upward and outward to unlock the containment plate 28 to permit rotation of the turntable 20. Conversely, raising the handle 58 lowers the plates 100 for locking the containment plate in the position sealing the opening in the front panel 21.

Figure 9B:
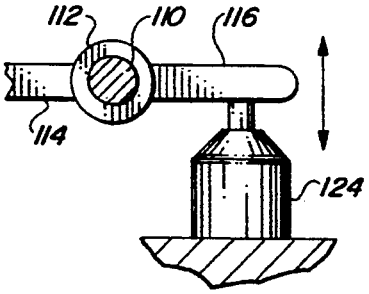
FIG. 9B is a schematic view similar to a portion of FIG. 9A, showing an alternative actuator arrangement.

If desired, a pneumatic actuator 124 may be installed to act with the lever 16, shaft 110 and cam 114 in place of the links 118, 120, as shown in FIG. 9B.

The system of the invention is provided with safety interlocks such that if the containment chamber 32 is not closed and locked—i.e., the containment plate 28 is not in the position aligned with the opening and the locking plates 100 lowered and locked—air cannot flow into the BACs that are positioned for charging in the chamber. Toggle-operated gate valves responsive respectively to the positions of the turntable and the locking plates are connected in series to control the flow of air to the BACs to be charged within the chamber 32. These are illustrated in the schematic views of FIGS. 10 and 11.

Figure 10:
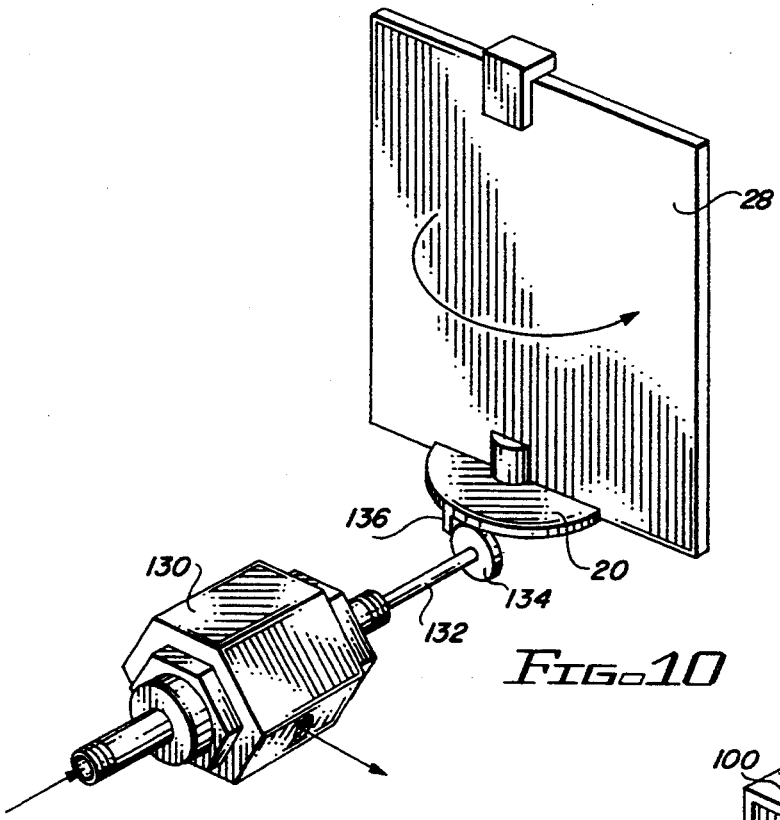
FIG. 10 is a schematic view illustrating an arrangement for monitoring the position of the turntable and activating the charging system when the protective separator plate is in the proper position for locking.

FIG. 10 shows the containment plate 28 on turntable 20 mounted for rotation about a vertical axis. A gate valve 130 is shown having a toggle lever 132 and follower 134 for valve control. The turntable 20 is provided with a detent 136 in a position to effect vertical displacement of the follower 134 as the turntable rotates. A similar detent, not shown, is positioned on the other side of the containment plate 28, 180 degrees displaced from detent 136. In addition to activating the gate valve 130, this detent arrangement also preliminarily arrests rotation of the turntable at the desired position. Air flow direction through the valve 130 is indicated by the arrows. The valve is closed except when the lever 132 is displaced by the follower 134 being moved downward by the detent 136.

Figure 11:
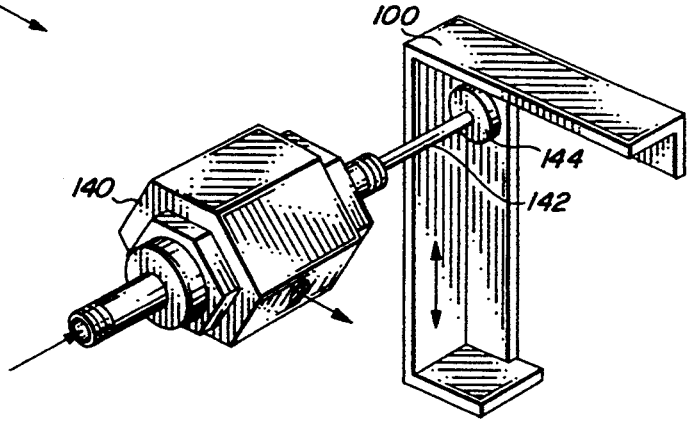
FIG. 11 is a schematic view representing a like arrangement for monitoring the position of the locking plates and activating the charging system when the plates are in the locked position.

FIG. 11 shows a similar gate valve 140 with an actuating lever 142 and follower 144 in position to respond to downward movement of a corresponding one of the locking plates 100. A second gate valve and lever arrangement is associated with the other locking plate 100 on the opposite side of the front panel opening 22. As with the valve 130, air is blocked by the valve 140 until its associated locking plate 100 is in the proper position for locking the turntable.

Figure 12:
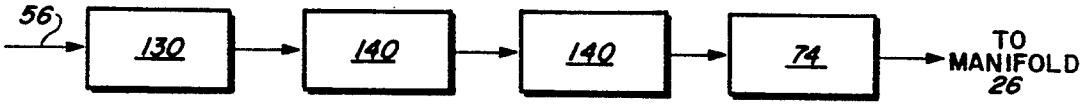
FIG. 12 is a block diagram showing the interconnection of safety interlocks in the system of FIG. 1.

FIG. 12 is a block diagram illustrating the interconnection of the gate valves 130, 140 in series with the high pressure inlet line 56 and the spherical valve 74. The turntable position sensing gate valve 130 and the two locking plate sensing valves 140 must all be activated in order for the path for compressed air from the line 56 to the distribution valve 74 to be opened to permit air flow. Similarly, the spherical valve 74 must be properly aligned (see FIG. 4) for air to be transferred to the manifold 26 on the inner side of the containment plate 28. In this manner, the safety interlock system insures that the BACs cannot be charged until the integrity of the containment chamber is assured.

The control panel 47 contains stainless steel safety pressure gauges 46 for displaying pressure readings for air from the compressor, air in the cylinders 18 of the storage module 16, and the BACs being charged. Automatic valves are provided to control the transfer of air to and from the tanks 18 in the storage module 16 and to the BACs being charged. Manual valves are provided for bleeding of the charge adapters 24 when the charged BACs are transported by the carousel 20 to the outside of the chamber 32. Automatic control valves also serve to prevent compressed air from re-entering the purification system associated with the compressor in the module 12 as well as delivering air from the storage system 16 to the BACs being charged. The system also has a regulated outlet (not shown) for attaching a fill hose for charging remote cylinders.

Safety relief valves are provided to prevent overcharging both high and low pressure BACs. Pressure regulators are provided to charge BACs to any preselected pressure.

In automatic operation of the system, the procedure begins with the loading of two BACs 23 on the exposed charge adapters 24 as indicated in FIG. 1. The turntable 20 is then rotated manually until it reaches a detent to place the BACs 23 within the chamber in position for charging—i.e., with the passage 88 of the valve 74 aligned with the port 90. Next, the regulator control valve 48 is adjusted to set the desired charge pressure. Pressing a charge push button on the front panel 47 engages the locks 100 and initiates the automatic charging of the cylinders 23 within the chamber 32.

As the cylinders inside the chamber 32 are being charged, the operator loads two more BACs 23 on the second pair of exposed charge adapters 24. When the first pair of cylinders are filled to the preset pressure, the system automatically stops filling and disengages the turntable locks. The operator then rotates the turntable 20 to place the second pair of cylinders in the charging position within the chamber 32 and brings the filled cylinders to the outside. Next the operator closes the valves on the filled BA cylinders, bleeds the air from the adapters 24 via bleed valve 96 and removes the pair of filled cylinders. Another pair of cylinders to be filled is mounted on the adapters 24 and the entire procedure is repeated.

Thus, arrangements in accordance with the present invention comprise an improved fill station for breathing air cylinders which provides a solution to certain problems previously encountered in apparatus for this purpose. Such arrangements achieve added simplicity, protection and speed in charging the cylinders to be filled with complete safety. Different embodiments are provided for both automatic and manual control of system operation. Handling and filling of breathing air cylinders is accomplished with rapidity on a virtual "production line" basis. This is important when a substantial number of cylinders are to be charged, as in a Fire Department facility or when re-charging is needed using vehicle-mounted equipment at the site of a fire.

Although there have been described hereinabove various specific arrangements of a rotary fill station for breathing apparatus in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A containment system for automatically charging breathing air cylinders with safety comprising:

a containment chamber having a peripheral shell of explosion containment material, the shell including a front panel defining an opening configured to receive a rotatable closure member therein;

a turntable mounted for rotation about a vertical axis adjacent the center of said opening and including means for supporting a plurality of air cylinders thereon in a generally upright attitude;

a plurality of fill adapters mounted on said turntable for coupling to corresponding air cylinders positioned at different azimuthal positions about said axis;

a multiple chamber valve coupled to said adapters and having port defining means within a valve body for opening an air passage to a set of adapters within the chamber as the valve body rotates with said turntable;

air passage means extending adjacent said axis from a point below the turntable to an inlet passage of the valve for transmitting compressed air to the valve from a source coupled to the lower end of the air passage means; and a containment plate extending across the turntable to substantially close said opening when the turntable is in position for charging air bottles within the chamber.

2. The system of claim 1 wherein the peripheral shell of the containment chamber comprises a generally planar front panel having a rectangular opening therein and wherein the containment plate conforms to the shape of said opening and extends along a diameter of the turntable.

3. The system of claim 2 wherein the peripheral edges of the containment plate are spaced from corresponding inner edges of the front panel opening by a gap sufficient to permit rotation of the containment plate within said opening.

4. The system of claim 3 further including a detent mechanism for arresting rotation of the turntable at a predetermined position with the containment plate extending across the opening.

5. The system of claim 3 further including means for selectively closing said gap and locking said containment plate and turntable against rotation.

6. The system of claim 5 wherein said locking means comprise a pair of locking plates slidably mounted along the inner face of said front panel adjacent opposite side edges of the opening.

7. The system of claim 6 wherein said locking plates are selectively movable between retracted positions away from said opening and extended positions overlapping said opening.

8. The system of claim 7 wherein the plane of the containment plate when in position to close the opening is displaced from the plane of the front panel and wherein the locking plates are movable in a plane between the planes of the containment plate and the front panel.

9. The system of claim 8 wherein said plates when in the extended position overlap portions of the front panel and the containment plate to lock the plate and turntable against rotation and prevent the containment plate from being forced outwardly through the opening upon explosive rupture of an air cylinder within the containment chamber.

10. The system of claim 7 further including a second interlock valve having an actuating lever which is responsive to the position of an associated locking plate in order to block compressed air from reaching the manifold which is positioned within the containment chamber except when the associated locking plate is in the extended position.

11. The system of claim 6 wherein the locking plates are mounted for movement in a bias direction substantially 45 degrees to the side edges of said opening, said plates being mounted to the front panel by threaded mounting bolts extending through a plurality of cam slots in the locking plates.

12. The system of claim 11 further including a pneumatic actuator coupled to an associated locking plate to move said plate from its extended position to a retracted position when the actuator is pressurized.

13. The system of claim 12 wherein the locking plate is slidable from the retracted position to the extended position in response to the force of gravity when the actuator is depressurized.

14. The system of claim 11 including a rotatable cross shaft positioned to the rear of the front panel and having a pair of cams mounted thereon to raise the locking plates from the extended to the retracted position, and a link coupled to said cross shaft for selectively rotating said cross shaft and cams to retract said plates.

15. The system of claim 14 further including a manual control apparatus coupling said link to a lever mounted externally of said containment chamber.

16. The system of claim 15 further including a pneumatic actuator positioned to move said link and rotate said shaft when the actuator is pressurized, thereby raising the locking plates to their retracted positions.

17. The system of claim 2 further including a pair of manifolds respectively coupled to associated sets of said fill adapters on opposite sides of said containment plate, and means for insuring that compressed air is directed only to the manifold and associated set of fill adapters on the side of the containment plate facing the interior of the containment chamber when the containment plate is in position across said opening.

18. The system of claim 17 further including a first interlock valve having an actuating lever which is responsive to the position of the turntable in order to block compressed air from reaching the manifold which is positioned within the containment chamber except when the turntable is rotated to the position where the containment plate blocks the opening.

19. The system of claim 1 wherein said multiple chamber valve is a ball valve having a spherical core defining an air passage positioned to communicate alternatively with outlet ports at opposite sides of the valve body.

20. The system of claim 19 further including mounting means for coupling the valve body to the containment plate for rotation therewith.

21. The system of claim 20 including means for maintaining the valve core fixed in position while the valve body rotates around it.

22. The system of claim 21 further including a rotary union coupling the lower end of the air passage means to the compressed air source.

* * * * *